US011680220B2

(12) United States Patent
Shono et al.

(10) Patent No.: US 11,680,220 B2
(45) Date of Patent: Jun. 20, 2023

(54) REFRIGERATION MACHINE OIL AND REFRIGERATION MACHINE OIL PRODUCTION METHOD

(71) Applicant: ENEOS Corporation, Tokyo (JP)

(72) Inventors: Yohei Shono, Tokyo (JP); Tatsuki Nakajima, Tokyo (JP); Shogo Hashimoto, Tokyo (JP); Hidetoshi Ogata, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 0 days.

(21) Appl. No.: 17/426,156

(22) PCT Filed: Jan. 21, 2020

(86) PCT No.: PCT/JP2020/002003
§ 371 (c)(1),
(2) Date: Jul. 28, 2021

(87) PCT Pub. No.: WO2020/158518
PCT Pub. Date: Aug. 6, 2020

(65) Prior Publication Data

US 2022/0098506 A1 Mar. 31, 2022

(30) Foreign Application Priority Data

Jan. 29, 2019 (JP) ..... JP2019-012840

(51) Int. Cl.
*C10M 173/02* (2006.01)
*C10M 137/02* (2006.01)
*C10M 169/04* (2006.01)
*C10N 40/30* (2006.01)

(52) U.S. Cl.
CPC ..... *C10M 137/02* (2013.01); *C10M 169/04* (2013.01); *C10M 2203/003* (2013.01); *C10M 2223/049* (2013.01); *C10N 2040/30* (2013.01)

(58) Field of Classification Search
CPC ..... C10M 137/02; C10M 169/04; C10M 2203/003; C10M 2223/049; C10N 2040/30
USPC ..... 508/441
See application file for complete search history.

(56) References Cited

U.S. PATENT DOCUMENTS

| | | | | |
|---|---|---|---|---|
| 2002/0055441 | A1 | 5/2002 | Hata et al. | |
| 2010/0005829 | A1 | 1/2010 | Kaneko et al. | |
| 2010/0234256 | A1 | 9/2010 | Sato et al. | |
| 2014/0305146 | A1* | 10/2014 | Dixon | C10M 171/008 62/84 |
| 2015/0048271 | A1* | 2/2015 | Kaneko | C10M 169/04 508/408 |
| 2018/0327688 | A1 | 11/2018 | Naitou et al. | |

FOREIGN PATENT DOCUMENTS

| | | |
|---|---|---|
| CN | 104177406 A | 12/2014 |
| JP | S55-092799 | 7/1980 |
| JP | H05-230488 | 9/1993 |
| JP | 2008-266423 | 11/2008 |
| JP | 2010-185017 | 8/2010 |
| JP | 2013-189506 | 9/2013 |
| JP | 2017-088651 | 5/2017 |
| JP | 2018-016736 | 2/2018 |
| JP | 2019-206672 | 12/2019 |
| WO | 2008/041508 | 4/2008 |
| WO | 2009/066722 | 5/2009 |

OTHER PUBLICATIONS

ISR issued in WIPO Patent Application No. PCT/JP2020/002003, Apr. 14, 2020, English translation.
IPRP issued in WIPO Patent Application No. PCT/JP2020/002003, Aug. 12, 2021, English translation.
Wang Zhongyou et,al., "The influence of phoshite on the antiwear ability of new type refrigerating machine oils," China Academic Journal Electronic Publishing House, Dec. 31, 1996, p. 50-p. 57, partial translation.

* cited by examiner

*Primary Examiner* — Prem C Singh
*Assistant Examiner* — Francis C Campanell
(74) *Attorney, Agent, or Firm* — Greenblum & Bernstein, P.L.C.

(57) ABSTRACT

The present invention provides a method for producing a refrigerating machine oil, comprising blending a hydrocarbyl hydrogen phosphite having an acid value of 100 mgKOH/g or less with a lubricating base oil or an oil composition containing a lubricating base oil, and a refrigerating machine oil obtained by the method.

6 Claims, No Drawings

REFRIGERATION MACHINE OIL AND REFRIGERATION MACHINE OIL PRODUCTION METHOD

TECHNICAL FIELD

The present invention relates to a refrigerating machine oil and a method for producing a refrigerating machine oil.

BACKGROUND ART

Refrigerating machines such as refrigerators, car air-conditioners, room air-conditioners, and automatic vending machines have a compressor for circulating a refrigerant in a refrigeration cycle. Further, the compressor is charged with a refrigerating machine oil for lubricating a sliding member. Generally, the refrigerating machine oil contains a base oil and an additive that are blended according to desired properties.

For example, as additives for improving the antiwear property of refrigerating machine oils, antiwear agents such as phosphorus-based antiwear agents and sulfur-based antiwear agents are known. In Patent Literature 1, a refrigerating machine oil containing a phosphorus-based additive including a phosphoric acid triester and/or a phosphorous acid triester is disclosed, and in Patent Literature 2, a refrigeration machine oil containing diphenyl hydrogen phosphite is disclosed.

CITATION LIST

Patent Literature

[Patent Literature 1] Japanese Unexamined Patent Publication No. 2008-266423

[Patent Literature 2] Japanese Unexamined Patent Publication No. 2018-16736

SUMMARY OF INVENTION

Technical Problem

However, there is still a room for improving the stability of the refrigerating machines oils using phosphorus-based additives as described above, while the refrigerating machine oils are excellent in antiwear property. Further, according to the study by the present inventors, it has been found that even if the refrigerating machine oils using the phosphorus-based additive exhibit excellent antiwear property at the initial stage, the antiwear property may decrease after long-term storage.

Therefore, it is an object of the present invention to provide a refrigerating machine oil which is excellent in stability and capable of maintaining excellent antiwear property for a long period of time, and a method for producing the refrigerating machine oil.

Solution to Problem

In order to solve the above problems, the present inventors have focused on a hydrocarbyl hydrogen phosphite. In addition, the present inventors have found that the hydrocarbyl hydrogen phosphite usually includes a monohydrocarbyl hydrogen phosphite and a dihydrocarbyl hydrogen phosphite, and the acid value increases as a portion of the dihydrocarbyl hydrogen phosphite changes over time to monohydrocarbyl hydrogen phosphite and/or hydrogen phosphite or the like during storage of the dihydrocarbyl hydrogen phosphite, and have found that the monohydrocarbyl hydrogen phosphite and/or hydrogen phosphite or the like serves as the cause of a decrease in the stability of refrigerating machine oil.

On the other hand, according to the study by the present inventors, it was also found that the monohydrocarbyl hydrogen phosphite and hydrogen phosphite significantly contribute to the improvement of antiwear property of refrigerating machine oil.

Therefore, the present inventors have found that the above-described problems can be solved by, using the "acid value" as an indicator in a case where monohydrocarbyl hydrogen phosphite and/or hydrogen phosphite is present in hydrocarbyl hydrogen phosphite, preparing a refrigerating machine oil using a hydrocarbyl hydrogen phosphite having a specific acid value, and have thereby completed the present invention.

That is, the present invention provides a method for producing a refrigerating machine oil, comprising blending a hydrocarbyl hydrogen phosphite having an acid value of 100 mgKOH/g or less with a lubricating base oil or an oil composition containing a lubricating base oil.

The hydrocarbyl hydrogen phosphite may comprise a monohydrocarbyl hydrogen phosphite and a dihydrocarbyl hydrogen phosphite, as described above.

The acid value of the hydrocarbyl hydrogen phosphite may be 30 mgKOH/g or less, and may be 10 mgKOH/g or less.

Further, the present invention also provides a refrigerating machine oil obtained by blending a hydrocarbyl hydrogen phosphite having an acid value of 100 mgKOH/g or less with a lubricating base oil or an oil composition containing a lubricating base oil.

Advantageous Effects of Invention

According to the present invention, a refrigerating machine oil which is excellent in stability and capable of maintaining excellent antiwear property for a long period of time, and a method for producing the refrigerating machine oil can be provided.

DESCRIPTION OF EMBODIMENTS

Hereinafter, embodiments of the present invention will be described in detail.

A refrigerating machine oil according to the present embodiment is obtained by blending a hydrocarbyl hydrogen phosphite having an acid value of 100 mgKOH/g or less (hereinafter, referred to as "hydrocarbyl hydrogen phosphite in the present embodiment"). The "hydrocarbyl hydrogen phosphite in the present embodiment" may comprise at least a monohydrocarbyl hydrogen phosphite and a dihydrocarbyl hydrogen phosphite. Further, the "acid value of hydrocarbyl hydrogen phosphite in the present embodiment" is used as an indicator in a case where monohydrocarbyl hydrogen phosphite and/or hydrogen phosphite is present in hydrocarbyl hydrogen phosphite.

The acid value of hydrocarbyl hydrogen phosphite in the present embodiment is preferably 80 mgKOH/g or less, more preferably 65 mgKOH/g or less, still more preferably 50 mgKOH/g or less, further preferably 30 mgKOH/g or less, and particularly preferably 10 mgKOH/g or less. The acid value of hydrocarbyl hydrogen phosphite in the present embodiment is preferably 0.1 mgKOH/g or more, more preferably 1 mgKOH/g or more, still more preferably 2 mgKOH/g or more, further preferably 3 mgKOH/g or more, particularly preferably 4 mgKOH/g or more, and may be 50 mgKOH/g or more. From the viewpoint that both stability and long-term antiwear property are achieved at a high level, the acid value of hydrocarbyl hydrogen phosphite may be 0.1 to 80 mgKOH/g, may be 1 to 65 mgKOH/g, may be 2 to 50 mgKOH/g, may be 3 to 30 mgKOH/g, and may be 4 to 10 mgKOH/g. Examples of the method for adjusting the acid value of hydrocarbyl hydrogen phosphite in the present embodiment include a method of partially hydrolyzing dihydrocarbyl hydrogen phosphite under contact conditions with a trace amount of moisture, oxygen, heat, metal, or the like, a method using hydrocarbyl hydrogen phosphite exhibiting a desired temporal change, or a method of removing monohydrocarbyl hydrogen phosphite and/or the hydrogen phosphite by purification or the like. When the hydrolysis of hydrocarbyl hydrogen phosphite progresses too much, or when the proportion of monohydrocarbyl hydrogen phosphite and/or hydrogen phosphite is high, the acid value exceeds 100 mgKOH/g, and the acid value rises remarkably and tends to deteriorate the stability, so that it is desirable to adjust the acid value to 100 mg KOH/g or less by purification or by mixing with dihydrocarbyl hydrogen phosphite that has not been hydrolyzed.

The hydrocarbyl hydrogen phosphite may be, for example, at least one of a compound represented by the following formula (1) and a compound represented by the following formula (2) which is a tautomer thereof, and the hydrocarbyl hydrogen phosphite in the present embodiment may contain the compound as a main component.

$$(R—O)_n—P(=O)—H_{3-n} \quad (1)$$

$$(R—O)_n—P—(OH)_{3-n} \quad (2)$$

In formulas (1) and (2), R represents, for example, a hydrocarbyl group having 1 to 20 carbon atoms, and more specific examples thereof include an alkyl group, a cycloalkyl group, a phenyl group, an aryl group, and an arylalkyl group. n represents an integer of 1 or 2.

The hydrocarbyl group represented by R may be linear, branched or cyclic. The number of carbon atoms of the hydrocarbyl group is preferably 4 to 12 or 13 to 20, more preferably 8 to 12 or 13 to 18, and still more preferably 14 to 18. When the number of carbon atoms of the hydrocarbyl group is 4 to 12, it is possible to maintain the antiwear property of the refrigerating machine oil particularly favorably, and when the number of carbon atoms is 13 to 20, it is possible to provide a refrigerating machine oil superior in stability. Further, the groups represented by a plurality of R in the same molecule may be the same or different, but are preferably the same from the viewpoint of ease of synthesis.

In the present invention, monohydrocarbyl hydrogen phosphite and dihydrocarbyl hydrogen phosphite having an alkyl group having 4 to 12 carbon atoms are preferable in terms of being superior in stability and antiwear property, and monohydrocarbyl hydrogen phosphite and dihydrocarbyl hydrogen phosphite having a hydrocarbyl group having 13 to 20 carbon atoms are preferable in terms of being particularly excellent in stability. As the hydrocarbyl group having 13 to 20 carbon atoms, an alkyl group or an alkenyl group having 13 to 18 carbon atoms which has a stearyl group or an oleyl group as a main component is preferable, and one that has an oleyl group as a main component is particularly preferable.

The amount of hydrocarbyl hydrogen phosphite (including its tautomer, the same applies hereinafter) blended in the present embodiment is preferably 0.005% by mass or more, more preferably 0.01% by mass or more, still more preferably 0.1% by mass or more, and particularly preferably 0.35% by mass or more, based on the total amount of refrigerating machine oil. Further, the amount thereof blended is preferably 5% by mass or less, more preferably 1% by mass or less, and particularly preferably 0.8% by mass or less.

As the hydrocarbyl hydrogen phosphite in the present embodiment, two or more kinds of hydrocarbyl hydrogen phosphite may be used in combination as long as the acid value is 100 mgKOH/g or less. Further, regarding the hydrocarbyl hydrogen phosphite, there is no particular limitation on the purity thereof as long as the refrigerating machine oil of the present embodiment is contained, and although it is desirable to use a pure product, it is not always necessary to use a pure product for reasons such as production process or purification cost. The purity of hydrocarbyl hydrogen phosphite to be blended in the refrigerating machine oil according to the present embodiment is preferably 50 mol % or more, and more preferably 70 mol % or more. The hydrocarbyl hydrogen phosphite in the present embodiment may be used as an additive containing the same as a main component.

A method for producing a refrigerating machine oil of the present embodiment includes, for example, a step of blending a hydrocarbyl hydrogen phosphite having an acid value of 100 mgKOH/g or less with a lubricating base oil or an oil composition containing a lubricating base oil.

In addition, in the present specification, the oil composition containing a lubricating base oil is one containing, in addition to a lubricating base oil, other additives described later. In this case, the content of the lubricating base oil in the oil composition may be 50% by mass or more, may be 70% by mass or more, and may be 90% by mass or more, based on the total amount of the oil composition.

As the lubricating base oil, it is possible to use a hydrocarbon oil, an oxygen-containing oil or the like. Examples of the hydrocarbon oil include mineral oil-based hydrocarbon oils and synthetic hydrocarbon oils. Examples of the oxygen-containing oil include esters, ethers, carbonates, ketones, silicones, and polysiloxanes.

The mineral oil-based hydrocarbon oil can be obtained by purifying a lubricating oil fraction obtained by subjecting crude oil such as paraffinic or naphthenic crude oil to atmospheric distillation and vacuum distillation by a method such as solvent deasphalting, solvent purification, hydrogenation purification, hydrogenolysis, solvent dewaxing, hydrogenation dewaxing, clay treatment, sulfuric acid washing, or the like. These purification methods may be used alone or in combination of two or more.

Examples of the synthetic hydrocarbon oil include alkylbenzene, alkylnaphthalene, poly-α-olefin (PAO), polybutene, and ethylene-α-olefin copolymers.

As the alkylbenzene, it is possible to use the following alkylbenzene (A) and/or alkylbenzene (B).

Alkylbenzene (A): alkylbenzene which has 1 to 4 alkyl groups having 1 to 19 carbon atoms and in which the total number of carbon atoms of the alkyl groups is 9 to 19 (preferably, alkylbenzene which has 1 to 4 alkyl groups having 1 to 15 carbon atoms and in which the total number of carbon atoms of the alkyl groups is 9 to 15).

Alkylbenzene (B): alkylbenzene which has 1 to 4 alkyl groups having 1 to 40 carbon atoms and in which the total number of carbon atoms of the alkyl groups is 20 to 40 (preferably, alkylbenzene which has 1 to 4 alkyl groups having 1 to 30 carbon atoms and in which the total number of carbon atoms of the alkyl groups is 20 to 30).

Specific examples of the alkyl group having 1 to 19 carbon atoms of the alkylbenzene (A) include a methyl group, an ethyl group, a propyl group (including all isomers, the same applies hereinafter), a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, and an exocil group. These alkyl groups may be linear or branched, and are preferably branched in terms of stability, viscosity characteristics and the like. In particular, in terms of availability, branched alkyl groups derived from oligomers of olefins such as propylene, butene and isobutylene are more preferable.

The number of alkyl groups in the alkylbenzene (A) is 1 to 4, preferably 1 or 2 (that is, monoalkylbenzene, dialkylbenzene, or a mixture thereof) in terms of stability and availability.

The alkylbenzene (A) may contain only alkylbenzene with a single structure, or may contain a mixture of alkylbenzenes with different structures as long as the alkylbenzenes satisfies the conditions of having 1 to 4 alkyl groups having 1 to 19 carbon atoms and the total number of carbon atoms of alkyl groups being 9 to 19.

Specific examples of the alkyl group having 1 to 40 carbon atoms of the alkylbenzene (B) include a methyl group, an ethyl group, a propyl group (including all isomers, the same applies hereinafter), a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an icosyl group, a heneicosyl group, a docosyl group, a tricosyl group, a tetracosyl group, a pentacosyl group, a hexacosyl group, a heptacosyl group, an octacosyl group, a nonacosyl group, a triacontyl group, a hentriacontyl group, a dotriacontyl group, a tritriacontyl group, a tetratriacontyl group, a pentatriacontyl group, a hexatriacontyl group, a heptatriacontyl group, an octatriacontyl group, a nonatriacontyl group, and a tetracontyl group. These alkyl groups may be linear or branched, and are preferably branched in terms of stability, viscosity characteristics and the like. In particular, in terms of availability, branched alkyl groups derived from oligomers of olefins such as propylene, butene and isobutylene are more preferable.

The number of alkyl groups in the alkylbenzene (B) is 1 to 4, preferably 1 or 2 (that is, monoalkylbenzene, dialkylbenzene, or a mixture thereof) in terms of stability and availability.

The alkylbenzene (B) may contain only alkylbenzene with a single structure, or may contain a mixture of alkylbenzenes with different structures as long as the alkylbenzenes satisfies the conditions of having 1 to 4 alkyl groups having 1 to 40 carbon atoms and the total number of carbon atoms of alkyl groups being 20 to 40.

The poly-α-olefin (PAO) is a compound obtained, for example, by polymerizing a molecule of a linear olefin having 6 to 18 carbon atoms having a double bond on only one of the ends, and then hydrogenating the molecule. The poly-α-olefin may be, for example, an isoparaffin having a molecular weight distribution which is centered around a trimer or tetramer of α-decene having 10 carbon atoms or α-dodecene having 12 carbon atoms.

Examples of the ester include aromatic esters, dibasic acid esters, polyol esters, complex esters, carbonic acid esters, and mixtures thereof. As the ester, a polyol ester or a complex ester is preferable.

The polyol ester is an ester of a polyhydric alcohol and a fatty acid. As the fatty acid, saturated fatty acid is preferably used. It is preferable for the number of carbon atoms of the fatty acid to be 4 to 20, more preferable to be 4 to 18, still more preferable to be 4 to 9, and particularly preferable to be 5 to 9. The polyol ester may be a partial ester in which some of the hydroxyl groups of the polyhydric alcohol are not esterified and remain as hydroxyl groups, may be a complete ester in which all the hydroxyl groups are esterified, or may be a mixture of a partial ester and a complete ester. The hydroxyl value of the polyol ester is preferably 10 mgKOH/g or less, more preferably 5 mgKOH/g or less, and still more preferably 3 mgKOH/g or less.

Of the fatty acids constituting the polyol ester, it is preferable for the proportion of fatty acids having 4 to 20 carbon atoms to be 20 to 100 mol %, more preferable to be 50 to 100 mol %, still more preferable to be 70 to 100 mol %, and particularly preferable to be 90 to 100 mol %.

Specific examples of fatty acids having 4 to 20 carbon atoms include a butanoic acid, a pentanoic acid, a hexanoic acid, a heptanoic acid, an octanoic acid, a nonanoic acid, a decanoic acid, a undecanoic acid, a dodecanoic acid, a tridecanoic acid, a tetradecanoic acid, a pentadecanoic acid, a hexadecanoic acid, a heptadecanoic acid, an octadecanoic acid, a nonadecanoic acid, and an icosanoic acid. These fatty acids may be linear or branched. More specifically, a fatty acid having a branch at the α-position and/or β-position is preferable, and 2-methylpropanoic acid, 2-methylbutanoic acid, 2-methylpentanoic acid, 2-methylhexanoic acid, 2-ethylpentanoic acid, 2-methyiheptanoic acid, 2-ethylhexanoic acid, 3,5,5-trimethylhexanoic acid, 2-ethylhexadecanoic acid and the like are more preferable, and among them, 2-ethyihexanoic acid, 3,5,5-trimethylhexanoic acid are still more preferable.

The fatty acid may contain a fatty acid other than the fatty acid having 4 to 20 carbon atoms. The fatty acid other than the fatty acid having 4 to 20 carbon atoms may be, for example, a fatty acid having 21 to 24 carbon atoms. Specific examples thereof include henicoic acid, docosanoic acid, tricosanoic acid, and tetracosanoic acid. These fatty acids may be linear or branched.

As the polyhydric alcohol constituting the polyol ester, a polyhydric alcohol having 2 to 6 hydroxyl groups is preferably used. The number of carbon atoms of the polyhydric alcohol is preferably 4 to 12, and more preferably 5 to 10. Specifically, neopentyl polyols such as neopentyl glycol, trimethylolethane, trimethylolpropane, trimethylolbutane, di-(trimethylolpropane), tri-(trimethylolpropane), pentaerythritol, and dipentaerythritol are preferable. Pentaerythritol or a mixed ester of pentaerythritol and dipentaerythritol as a main component is more preferable because it is particularly excellent in compatibility with a refrigerant and hydrolysis stability.

The complex ester is, for example, an ester synthesized by the following method (a) or (b).

(a) a method of synthesizing an ester intermediate in which a part of carboxyl groups of a polybasic acid is not esterified by adjusting a molar ratio between the polyhydric alcohol and the polybasic acid, and then esterifying the remaining carboxyl group with a monohydric alcohol (b) a method of synthesizing an ester intermediate in which a part of hydroxyl groups of a polyhydric alcohol is not esterified by adjusting a molar ratio between the polyhydric alcohol and the polybasic acid, and then esterifying the remaining hydroxyl group with a monovalent fatty acid There is low possibility that a relatively strong acid is produced when hydrolyzed when used as a refrigerating machine oil, so that the complex ester obtained by the above method (a) tends to be more excellent in stability compared to the complex ester obtained by the above method (b). As the complex ester in the present embodiment, the complex ester obtained by the above method (a), which has higher stability, is preferable.

The complex ester is preferably an ester synthesized from at least one selected from polyhydric alcohols having 2 to 4 hydroxyl groups, at least one selected from polybasic acids having 6 to 12 carbon atoms, and at least one selected from monohydric alcohols having 4 to 18 carbon atoms and monovalent fatty acids having 2 to 12 carbon atoms.

Examples of the polyhydric alcohol having 2 to 4 hydroxyl groups include neopentyl glycol, trimethylolpropane, and pentaerythritol. As the polyhydric alcohol having 2 to 4 hydroxyl groups, neopentyl glycol and trimethylolpropane are preferable from the viewpoint that good low-temperature characteristics are obtained by ensuring a suitable viscosity when the complex ester is used as a base oil, and neopentyl glycol is more preferable from the viewpoint that the viscosity can be widely adjusted.

From the viewpoint of excellent lubricity, it is preferable for the polyhydric alcohol constituting the complex ester to further contain a dihydric alcohol having 2 to 10 carbon atoms other than neopentyl glycol in addition to the polyhydric alcohol having 2 to 4 hydroxyl groups. Examples of the dihydric alcohol having 2 to 10 carbon atoms other than neopentyl glycol include ethylene glycol, propanediol, butanediol, pentanediol, hexanediol, 2-methyl-1,3-propanediol, 3-methyl-1,5-pentanediol, and 2,2-diethyl-1,3-pentanediol. Among these, butanediol is preferable from the viewpoint of excellent characteristics of the lubricating base oil. Examples of butanediol include 1,2-butanediol, 1,3-butanediol, 1,4-butanediol, and 2,3-butanediol. Among these, 1,3-butanediol and 1,4-butanediol are more preferable from the viewpoint that good characteristics are obtained. It is preferable for the amount of the dihydric alcohol having 2 to 10 carbon atoms other than neopentyl glycol to be 1.2 mol or less, more preferable to be 0.8 mol or less, and still more preferable to be 0.4 mol or less, with respect to 1 mol of the polyhydric alcohol having 2 to 4 hydroxyl groups.

Examples of the polybasic acid having 6 to 12 carbon atoms include adipic acid, pimelic acid, suberic acid, azelaic acid, sebacic acid, phthalic acid, and trimellitic acid. Among these, adipic acid and sebacic acid are preferable, and adipic acid is more preferable, from the viewpoint of excellent balance of characteristics of the synthesized ester and easy availability. It is preferable for the amount of the polybasic acid having 6 to 12 carbon atoms to be 0.4 mol to 4 mol, more preferable to be 0.5 mol to 3 mol, and still more preferable to be 0.6 mol to 2.5 mol, with respect to 1 mol of the polyhydric alcohol having 2 to 4 hydroxyl groups.

Examples of the monohydric alcohol having 4 to 18 carbon atoms include aliphatic alcohols such as butanol, pentanol, hexanol, heptanol, octanol, nonanol, decanol, dodecanol, and oleyl alcohol. These monohydric alcohols may be linear or branched. The monohydric alcohol having 4 to 18 carbon atoms is preferably a monohydric alcohol having 6 to 10 carbon atoms, and more preferably a monohydric alcohol having 8 to 10 carbon atoms, in terms of the balance of characteristics. Among these, 2-ethylhexanol and 3,5,5-trimethylhexanol are still more preferable from the viewpoint that the low-temperature characteristics of the synthesized complex ester becomes good.

Examples of monovalent fatty acids having 2 to 12 carbon atoms include ethane acid, propanoic acid, butanoic acid, pentanoic acid, hexanoic acid, heptanoic acid, octanoic acid, nonanoic acid, decanoic acid, and dodecanoic acid. These monovalent fatty acids may be linear or branched. The monovalent fatty acid having 2 to 12 carbon atoms is preferably a monovalent fatty acid having 8 to 10 carbon atoms, and more preferably 2-ethylhexanoic acid and 3,5,5-trimethylhexanoic acid among these from the viewpoint of low-temperature characteristics.

Examples of the ether include polyvinyl ether, polyalkylene glycol, polyphenyl ether, perfluoro ether, and a mixture thereof. As the ether, polyvinyl ether or polyalkylene glycol is preferable, and polyvinyl ether is more preferable.

Polyvinyl ether has a structural unit represented by the following formula (3).

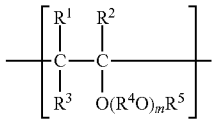

(3)

In formula (3), $R^1$, $R^2$ and $R^3$ may be the same as or different from each other and each represent a hydrogen atom or a hydrocarbon group, $R^4$ represents a divalent hydrocarbon group or a divalent ether-bonded oxygen-containing hydrocarbon group, $R^5$ represents a hydrocarbon group, and m represents an integer of 0 or more. In a case where m is 2 or more, the plurality of $R^4$ may be the same as or different from each other.

The number of carbon atoms of the hydrocarbon groups represented by $R^1$, $R^2$ and $R^3$ is preferably 1 or more, more preferably 2 or more, still more preferably 3 or more, and preferably 8 or less, more preferably 7 or less, still more preferably 6 or less. It is preferable for at least one of $R^1$, $R^2$ and $R^3$ to be a hydrogen atom, and it is more preferable for all of $R^1$, $R^2$ and $R^3$ to be a hydrogen atom.

The number of carbon atoms of the divalent hydrocarbon group and the ether-bonded oxygen-containing hydrocarbon group represented by $R^4$ is preferably 1 or more, more preferably 2 or more, still more preferably 3 or more, and preferably 10 or less, more preferably 8 or less, still more preferably 6 or less. The divalent ether-bonded oxygen-containing hydrocarbon group represented by $R^4$ may be, for example, a hydrocarbon group having oxygen forming an ether bond in the side chain.

It is preferable for $R^5$ to be a hydrocarbon group having 1 to 20 carbon atoms. Examples of this hydrocarbon group include an alkyl group, a cycloalkyl group, a phenyl group, an aryl group, and an arylalkyl group. Among these, an alkyl group is preferable, and an alkyl group having 1 to 5 carbon atoms is more preferable.

m is preferably 0 or more, more preferably 1 or more, still more preferably 2 or more, and preferably 20 or less, more preferably 18 or less, still more preferably 16 or less. It is preferable for the average value of m in all the structural units constituting the polyvinyl ether to be 0 to 10.

The polyvinyl ether may be a homopolymer constituted by one selected from the structural units represented by formula (3), may be a copolymer constituted by two or more selected from the structural units represented by formula (3), or may be a copolymer constituted by a structural unit represented by formula (3) and another structural unit. Since the polyvinyl ether is a copolymer, it is possible to further improve the lubricity, insulating property, hygroscopic property and the like while satisfying compatibility of the refrigerating machine oil with the refrigerant. At this time, by appropriately selecting the type of the monomer as the raw material, the type of the initiator, the ratio of the structural units in the copolymer, and the like, it is possible to set various characteristics of the refrigerating machine oil above to desired ones. The copolymer may be either a block copolymer or a random copolymer.

In a case where the polyvinyl ether is a copolymer, it is preferable for the copolymer to have a structural unit (3-1) which is represented by the above formula (3) and in which $R^5$ is an alkyl group having 1 to 3 carbon atoms and a structural unit (3-2) which is represented by the above formula (3) and in which $R^5$ is an alkyl group having 3 to 20 carbon atoms, preferably 3 to 10 carbon atoms, and still more preferably 3 to 8 carbon atoms. An ethyl group is particularly preferable as $R^5$ in the structural unit (3-1), and an isobutyl group is particularly preferable as $R^5$ in the structural unit (3-2). In a case where the polyvinyl ether is a copolymer having the above structural units (3-1) and (3-2), it is preferable for the molar ratio between the structural unit (3-1) and the structural unit (3-2) to be 5:95 to 95:5, more preferable to be 20:80 to 90:10, and still more preferable 70:30 to 90:10. When the molar ratio is within the above range, it is possible to further improve the compatibility with the refrigerant, and there is a tendency in that the hygroscopic property can be reduced.

The polyvinyl ether may only be constituted by the structural unit represented by the above formula (3), or may be a copolymer further having the structural unit represented by the following formula (4). In this case, the copolymer may be either a block copolymer or a random copolymer.

(4)

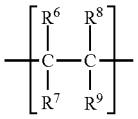

In formula (4), $R^6$ to $R^9$ may be the same as or different from each other, and each represent a hydrogen atom or a hydrocarbon group having 1 to 20 carbon atoms.

The polyvinyl ether can be produced by polymerizing a vinyl ether-based monomer corresponding to the structural unit represented by formula (3) or by copolymerizing a vinyl ether-based monomer corresponding to the structural unit represented by formula (3) with a hydrocarbon monomer having an olefinic double bond corresponding to the structural unit represented by formula (4). As the vinyl ether-based monomer corresponding to the structural unit represented by formula (3), a monomer represented by the following formula (5) is suitable.

(5)

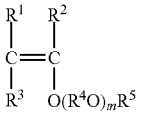

In the formula, $R^1$, $R^2$, $R^3$, $R^4$, $R^5$ and m represent the same definitions as $R^1$, $R^2$, $R^3$, $R^4$, $R^5$ and m in formula (3), respectively.

It is preferable for the polyvinyl ether to have the following terminal structure (A) or (B).

(A) structure in which one end is represented by formula (6) or (7) and the other end is represented by formula (8) or (9).

(6)

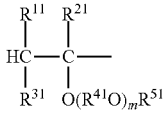

In formula (6), $R^{11}$, $R^{21}$ and $R^{31}$ may be the same as or different from each other, and each represents a hydrogen atom or a hydrocarbon group having 1 to 8 carbon atoms, $R^{41}$ represents a divalent hydrocarbon group or a divalent ether-bonded oxygen-containing hydrocarbon group having 1 to 10 carbon atoms, $R^{51}$ represents a hydrocarbon group having 1 to 20 carbon atoms, and m represents the same definition as m in formula (3). In a case where m is 2 or more, the plurality of $R^{41}$ may be the same as or different from each other.

(7)

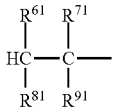

In formula (7), $R^{61}$, $R^{71}$, $R^{81}$ and $R^{91}$ may be the same as or different from each other, and each represent a hydrogen atom or a hydrocarbon group having 1 to 20 carbon atoms.

(8)

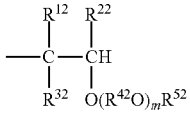

In formula (8), $R^{12}$, $R^{22}$ and $R^{32}$ may be the same as or different from each other, and each represents a hydrogen atom or a hydrocarbon group having 1 to 8 carbon atoms, $R^{42}$ represents a divalent hydrocarbon group or a divalent ether-bonded oxygen-containing hydrocarbon group having 1 to 10 carbon atoms, $R^{52}$ represents a hydrocarbon group having 1 to 20 carbon atoms, and m represents the same definition as m in formula (3). In a case where m is 2 or more, the plurality of $R^{41}$ may be the same or different.

(9)

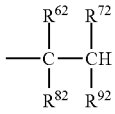

In formula (9), $R^{62}$, $R^{72}$, $R^{82}$ and $R^{92}$ may be the same as or different from each other, and each represent a hydrogen atom or a hydrocarbon group having 1 to 20 carbon atoms.

(B) structure in which one end is represented by the above formula (6) or (7) and the other end is represented by the following formula (10).

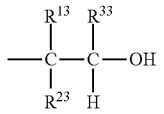

(10)

In formula (10), $R^{13}$, $R^{23}$, and $R^{33}$ may be the same as or different from each other, and each represent a hydrogen atom or a hydrocarbon group having 1 to 8 carbon atoms.

Among such polyvinyl ethers, the polyvinyl ethers (a), (b), (c), (d) and (e) listed below are particularly suitable as the base oil.

(a) polyvinyl ether having a structure in which one end is represented by formula (6) or (7) and the other end is represented by formula (8) or (9), in which R', $R^2$ and $R^3$ in formula (3) are all hydrogen atoms, m is an integer of 0 to 4, $R^4$ is a divalent hydrocarbon group having 2 to 4 carbon atoms, and $R^5$ is a hydrocarbon group having 1 to 20 carbon atoms.

(b) polyvinyl ether having only the structural unit represented by formula (3) and having a structure in which one end is represented by formula (6) and the other end is represented by formula (8), in which R', $R^2$ and $R^3$ in formula (3) are all hydrogen atoms, m is an integer of 0 to 4, $R^4$ is a divalent hydrocarbon group having 2 to 4 carbon atoms, and $R^5$ is a hydrocarbon group having 1 to 20 carbon atoms.

(c) polyvinyl ether having a structure in which one end is represented by formula (6) or (7) and the other end is represented by formula (10), in which R', $R^2$ and $R^3$ in formula (3) are all hydrogen atoms, m is an integer of 0 to 4, $R^4$ is a divalent hydrocarbon group having 2 to 4 carbon atoms, and $R^5$ is a hydrocarbon group having 1 to 20 carbon atoms.

(d) polyvinyl ether having only the structural unit represented by formula (3) and having a structure in which one end is represented by formula (7) and the other end is represented by formula (10), in which R', $R^2$ and $R^3$ in formula (3) are all hydrogen atoms, m is an integer of 0 to 4, $R^4$ is a divalent hydrocarbon group having 2 to 4 carbon atoms, and $R^5$ is a hydrocarbon group having 1 to 20 carbon atoms.

(e) polyvinyl ether being any of above (a), (b), (c) and (d) and having a structural unit in which $R^5$ in formula (3) is a hydrocarbon group having 1 to 3 carbon atoms and a structural unit in which the $R^5$ is a hydrocarbon group having 3 to 20 carbon atoms.

It is preferable for the unsaturation degree of polyvinyl ether to be 0.04 meq/g or less, more preferable to be 0.03 meq/g or less, and still more preferable to be 0.02 meq/g or less. It is preferable for the peroxide value of polyvinyl ether to be 10.0 meq/kg or less, more preferable to be 5.0 meq/kg or less, and still more preferable to be 1.0 meq/kg. It is preferable for the carbonyl value of polyvinyl ether to be 100 ppm by weight or less, more preferable to be 50 ppm by weight or less, and still more preferable to be 20 ppm by weight or less. It is preferable for the hydroxyl value of polyvinyl ether to be 10 mgKOH/g or less, more preferable to be 5 mgKOH/g or less, and still more preferable to be 3 mgKOH/g or less.

The unsaturation degree, the peroxide value, and the carbonyl value in the present invention refer to the values measured by the standard oil and fat analysis test method established by the Japan Oil Chemists' Society, respectively. That is, the unsaturation degree in the present invention refers to a value (meq/g) obtained by reacting a sample with a Wijs solution (ICl-acetic acid solution), allowing the sample to stand in a dark place, reducing excess ICl to iodine thereafter, titrating the iodine content with sodium thiosulfate to calculate an iodine value, and converting the iodine value into a vinyl equivalent. The peroxide value in the present invention refers to a value (meq/kg) obtained by adding potassium iodide to a sample, titrating the generated free iodine with sodium thiosulfate, and converting this free iodine into milliequivalents with respect to 1 kg of the sample. The carbonyl value in the present invention refers to a value (ppm by weight) obtained by allowing 2,4-dinitrophenylhydrazine to act on a sample to generate a chromogenic quinoid ion, measuring the absorbance of this sample at 480 nm, and converting into the carbonyl amount based on a calibration curve obtained in advance using cinnamaldehyde as a standard substance. The hydroxyl value in the present invention means a hydroxyl value measured in accordance with JIS K0070:1992.

Examples of the polyalkylene glycol include polyethylene glycol, polypropylene glycol, and polybutylene glycol. The polyalkylene glycol has oxyethylene, oxypropylene, oxybutylene and the like as structural units. The polyalkylene glycols having these structural units can be obtained by ring-opening polymerization using ethylene oxide, propylene oxide, and butylene oxide as monomers, respectively, as raw materials.

Examples of the polyalkylene glycol include compounds represented by the following formula (11).

$$R^{\alpha}—[(OR^{\beta})_f—OR^{\gamma}]_g \quad (11)$$

In formula (11), $R^{\alpha}$ represents a hydrogen atom, an alkyl group having 1 to 10 carbon atoms, an acyl group having 2 to 10 carbon atoms, or a residue of a compound having 2 to 8 hydroxyl groups, $R^{\beta}$ represents an alkylene group having 2 to 4 carbon atoms, RY represents a hydrogen atom, an alkyl group having 1 to 10 carbon atoms, or an acyl group having 2 to 10 carbon atoms, f represents an integer of 1 to 80, and g represents an integer of 1 to 8.

The alkyl group represented by $R^{\alpha}$ or RY may be linear, branched or cyclic. The number of carbon atoms of the alkyl group is preferably 1 to 10, and more preferably 1 to 6. When the number of carbon atoms of the alkyl group is 10 or less, there is a tendency in that the compatibility with the refrigerant is well maintained.

The alkyl group portion of the acyl group represented by $R^{\alpha}$ or $R^{\gamma}$ may be linear, branched or cyclic. The number of carbon atoms of the acyl group is preferably 2 to 10, and more preferably 2 to 6. When the number of carbon atoms of the acyl group is 10 or less, the compatibility with the refrigerant is maintained and the possibility that phase separation occurs is low.

In a case where the groups represented by $R^{\alpha}$ and $R^{\gamma}$ are both alkyl groups, or in a case of both being acyl groups, the groups represented by $R^{\alpha}$ and $R^{\gamma}$ may be the same or different. In a case where g is 2 or more, the groups represented by a plurality of $R^{\alpha}$ and $R^{\gamma}$ in the same molecule may be the same or different.

In a case where the group represented by $R^{\alpha}$ is a residue of a compound having 2 to 8 hydroxyl groups, this compound may be linear or cyclic.

At least one of $R^{\alpha}$ and $R^{\gamma}$ is preferably an alkyl group, more preferably an alkyl group having 1 to 4 carbon atoms, and still more preferably a methyl group from the viewpoint of excellent compatibility. From the viewpoint of excellent thermal/chemical stability, both $R^{\alpha}$ and $R^{\gamma}$ are preferably an alkyl group, more preferably an alkyl group having 1 to 4 carbon atoms, and still more preferably a methyl group. From the viewpoint of ease of production and cost, it is preferable that either one of $R^{\alpha}$ and $R^{\gamma}$ be an alkyl group (more preferably, an alkyl group having 1 to 4 carbon atoms) and the other be a hydrogen atom, and more preferable that one be a methyl group and the other be a hydrogen atom. From the viewpoint of excellent lubricity and sludge solubility, it is preferable that both $R^{\alpha}$ and $R^{\gamma}$ be hydrogen atoms.

$R^{\beta}$ represents an alkylene group having 2 to 4 carbon atoms, and specific examples of such an alkylene group include an ethylene group, a propylene group, and a butylene group. Examples of the oxyalkylene group of the repeating unit represented by $OR^{\beta}$ include an oxyethylene group, an oxypropylene group, and an oxybutylene group. The oxyalkylene group represented by $(OR^{\beta})_f$ may be constituted by one kind of oxyalkylene group or two or more kinds of oxyalkylene group.

Among the polyalkylene glycols represented by formula (11), from the viewpoint of excellent compatibility with the refrigerant and viscosity-temperature characteristics, a copolymer containing an oxyethylene group (EO) and an oxypropylene group (PO) is preferable. In this case, it is preferable for the proportion of the oxyethylene group (EO/(PO+EO)) to the total sum of the oxyethylene group and the oxypropylene group to be 0.1 to 0.8, and more preferable to be 0.3 to 0.6, from the viewpoint of excellent seizure load and viscosity-temperature characteristics. From the viewpoint of excellent hygroscopic property and thermal/oxidative stability, it is preferable for EO/(PO+EO) to be 0 to 0.5, more preferable to be 0 to 0.2, and most preferable to be 0 (that is, propylene oxide homopolymer).

f represents the number of repetitions (polymerization degree) of the oxyalkylene group $OR^{\beta}$, and is an integer of 1 to 80. g is an integer from 1 to 8. For example, in a case where $R^{\alpha}$ is an alkyl group or an acyl group, g is 1. In a case where $R^{\alpha}$ is a residue of a compound having 2 to 8 hydroxyl groups, g is the number of hydroxyl groups that the compound has.

In polyalkylene glycol represented by formula (11), it is preferable for the average value of the product (f×g) of f and g to be 6 to 80 from the viewpoint of satisfying the required performance as a refrigerating machine oil in a well-balanced manner.

The number-average molecular weight of the polyalkylene glycol represented by formula (11) is preferably 500 or more, more preferably 600 or more, and preferably 3000 or less, more preferably 2000 or less, still more preferably 1500 or less. It is preferable for f and g to be numbers such that the number-average molecular weight of the polyalkylene glycol satisfies the above conditions. When the number-average molecular weight of the polyalkylene glycol is 500 or more, lubricity under coexistence of the refrigerant becomes sufficient. When the number-average molecular weight is 3000 or less, the composition range showing compatibility with the refrigerant is wide even under low-temperature conditions, and poor lubrication of the refrigerant compressor and inhibition of heat exchange in the evaporator are less likely to occur.

The hydroxyl value of the polyalkylene glycol is preferably 100 mgKOH/g or less, more preferably 50 mgKOH/g or less, still more preferably 30 mgKOH/g or less, and most preferably 10 mgKOH/g or less.

Polyalkylene glycols can be synthesized using known methods ("alkylene oxide polymer", Mita Shibata et al., Kaibundo, published on Nov. 20, 1990). For example, the polyalkylene glycol represented by the formula (11) can be obtained by subjecting an alcohol ($R^{\alpha}OH$; $R^{\alpha}$ represents the same definition as $R^{\alpha}$ in formula (11)) to addition polymerization with one or more kinds of predetermined alkylene oxides and then etherifying or esterifying a terminal hydroxyl group. In a case where two or more kinds of alkylene oxides are used in the above production process, the obtained polyalkylene glycol may be either a random copolymer or a block copolymer, but it is preferable for the polyalkylene glycol to be a block copolymer because it tends to be superior in oxidation stability and lubricity, and it is preferable for the polyalkylene glycol to be a random copolymer because it tends to be superior in low-temperature fluidity.

It is preferable for the unsaturation degree of polyalkylene glycol to be 0.04 meq/g or less, more preferable to be 0.03 meq/g or less, and most preferable to be 0.02 meq/g or less. It is preferable for the peroxide value to be 10.0 meq/kg or less, more preferable to be 5.0 meq/kg or less, and most preferable to be 1.0 meq/kg. It is preferable for the carbonyl value to be 100 ppm by weight or less, more preferable to be 50 ppm by weight or less, and most preferable to be 20 ppm by weight or less.

The kinematic viscosity of the lubricating base oil at 40° C. may be preferably 3 $mm^2/s$ or more, more preferably 4 $mm^2/s$ or more, and still more preferably 5 $mm^2/s$ or more. The kinematic viscosity of the lubricating base oil at 40° C. may be preferably 1000 $mm^2/s$ or less, more preferably 500 $mm^2/s$ or less, and still more preferably 400 $mm^2/s$ or less. The kinematic viscosity of the lubricating base oil at 100° C. may be preferably 1 $mm^2/s$ or more, and more preferably 2 $mm^2/s$ or more. The kinematic viscosity of the lubricating base oil at 100° C. may be preferably 100 $mm^2/s$ or less, and more preferably 50 $mm^2/s$ or less. The kinematic viscosity in the present invention means a kinematic viscosity measured in accordance with JIS K2283:2000.

The content of the lubricating base oil may be 50% by mass or more, 60% by mass or more, 70% by mass or more, 80% by mass or more, or 90% by mass or more, based on the total amount of refrigerating machine oil.

The refrigerating machine oil according to the present embodiment may further contain other additives in addition to the above-mentioned components. Examples of the other additives include an acid scavenger, an antioxidant, an extreme pressure agent, an oiliness agent, an antifoaming agent, a metal deactivator, a viscosity index improver, a pour point depressant, a detergent dispersant, and an antiwear agent other than the hydrocarbyl hydrogen phosphite in the present embodiment. In addition, these additives may be added before blending hydrocarbyl hydrogen phosphite in the present embodiment to the lubricating base oil, may be added after blending, or may be blended at the same time.

Examples of the acid scavenger include an epoxy compound (epoxy-based acid scavenger). Examples of the epoxy compound include a glycidyl ether type epoxy compound, a glycidyl ester type epoxy compound, an oxylan compound, an alkyloxylan compound, an alicyclic epoxy compound, an epoxidized fatty acid monoester, and an epoxidized vegetable oil. These epoxy compounds can be used alone or in combination of two or more.

As the glycidyl ether type epoxy compound, it is possible to use, for example, an aryl glycidyl ether type epoxy compound or an alkyl glycidyl ether type epoxy compound represented by the following formula (12).

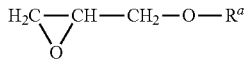

(12)

In formula (12), $R^a$ represents an aryl group or an alkyl group having 5 to 18 carbon atoms.

As the glycidyl ether type epoxy compound represented by formula (12), n-butylphenyl glycidyl ether, i-butylphenyl glycidyl ether, sec-butylphenyl glycidyl ether, tert-butylphenyl glycidyl ether, pentylphenyl glycidyl ether, and hexylphenyl glycidyl ether, heptylphenyl glycidyl ether, octylphenyl glycidyl ether, nonylphenyl glycidyl ether, decylphenyl glycidyl ether, decyl glycidyl ether, undecyl glycidyl ether, dodecyl glycidyl ether, tridecyl glycidyl ether, tetradecyl glycidyl ether, and 2-ethylhexyl glycidyl ether are preferable.

When the number of carbon atoms of the alkyl group represented by $R^a$ is 5 or more, the stability of the epoxy compound is secured, and it is possible to suppress the decomposition of the epoxy compound before reacting with moisture, a fatty acid, or an oxidatively deteriorated substance or the occurrence of self-polymerization in which the epoxy compounds are polymerized, and the desired function can be easily obtained. Meanwhile, when the number of carbon atoms of the alkyl group represented by $R^a$ is 18 or less, the solubility with the refrigerant is well maintained, and it is possible to prevent problems such as poor cooling from occurring due to precipitation in the refrigerating apparatus.

As the glycidyl ether type epoxy compound, in addition to the epoxy compound represented by the formula (12), it is also possible to use neopentyl glycol diglycidyl ether, trimethylolpropane triglycidyl ether, pentaerythritol tetraglycidyl ether, 1,6-hexanediol diglycidyl ether, sorbitol polyglycidyl ether, polyalkylene glycol monoglycidyl ether, polyalkylene glycol diglycidyl ether or the like.

As the glycidyl ester type epoxy compound, it is possible to use, for example, a compound represented by the following formula (13).

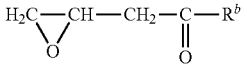

(13)

In formula (13), $R^b$ represents an aryl group, an alkyl group having 5 to 18 carbon atoms, or an alkenyl group.

As the glycidyl ester type epoxy compound represented by formula (13), glycidyl benzoate, glycidyl neodecanoate, glycidyl-2,2-dimethyloctanoate, glycidyl acrylate, and glycidyl methacrylate are preferable.

When the number of carbon atoms of the alkyl group represented by $R^b$ is 5 or more, the stability of the epoxy compound is secured, and it is possible to suppress the decomposition of the epoxy compound before reacting with moisture, a fatty acid, or an oxidatively deteriorated substance or the occurrence of self-polymerization in which the epoxy compounds are polymerized, and the desired function can be easily obtained. Meanwhile, when the number of carbon atoms of the alkyl group or the alkenyl group represented by $R^b$ is 18 or less, the solubility with the refrigerant is well maintained, and it is possible to prevent problems such as poor cooling from occurring due to precipitation in the refrigerating machine.

The alicyclic epoxy compound is a compound represented by the following formula (14) and having a partial structure in which carbon atoms constituting the epoxy group directly constitute an alicyclic ring.

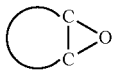

(14)

As the alicyclic epoxy compound, 1,2-epoxycyclohexane, 1,2-epoxycyclopentane, 3',4'-epoxycyclohexylmethyl-3,4-epoxycyclohexanecarboxylate, bis(3,4-epoxycyclohexylmethyl)adipate, exo-2,3-epoxynorbornane, bis(3,4-epoxy-6-methylcyclohexylmethyl)adipate, 2-(7-oxabicyclo [4.1.0] hept-3-yl)-spiro(1,3-dioxane-5,3'-[7]oxabicyclo [4.1.0] heptane, 4-(1'-methylepoxyethyl)-1,2-epoxy-2-methylcyclohexane, and 4-epoxyethyl-1,2-epoxycyclohexane are preferable.

Examples of the allyloxylane compound include 1,2-epoxystyrene and alkyl-1,2-epoxystyrene.

Examples of the alkyloxylan compound include 1,2-epoxybutane, 1,2-epoxypentane, 1,2-epoxyhexane, 1,2-epoxyheptan, 1,2-epoxyoctane, 1,2-epoxynonane, 1,2-epoxy decane, 1,2-epoxy undecane, 1,2-epoxy dodecane, 1,2-epoxy tridecane, 1,2-epoxy tetradecane, 1,2-epoxy pentadecane, 1,2-epoxy hexadecane, 1,2-epoxy heptadecane, 1,1,2-epoxy octadecane, 2-epoxy nonadecan, and 1,2-epoxy icosan.

Examples of the epoxidized fatty acid monoester include an ester of an epoxidized fatty acid having 12 to 20 carbon atoms and an alcohol having 1 to 8 carbon atoms or a phenol or an alkylphenol. As the epoxidized fatty acid monoester, butyl, hexyl, benzyl, cyclohexyl, methoxyethyl, octyl, phenyl and butylphenyl ester of epoxy stearic acid are preferably used.

Examples of the epoxidized vegetable oil include epoxy compounds of vegetable oils such as soybean oil, linseed oil, and cottonseed oil.

The epoxy compound is preferably at least one selected from glycidyl ester type epoxy compounds and glycidyl ether type epoxy compounds, and is preferably at least one selected from glycidyl ester type epoxy compounds from the viewpoint of excellent compatibility with a resin material (for example, nylon) used for a member in a refrigerating machine.

The content of the acid scavenger is preferably 0.1 to 4% by mass, more preferably 0.2 to 2% by mass, still more preferably 0.4 to 1.5% by mass, and particularly preferably 0.4 to 1.2% by mass, based on the remaining amount of refrigerating machine oil.

In a case where the refrigerating machine oil contains the glycidyl ester type epoxy compound as an epoxy compound, the content of the glycidyl ester type epoxy compound is preferably 0.01 to 2% by mass, more preferably 0.1 to 2% by mass, still more preferably 0.2 to 1.5% by mass, still further preferably 0.4 to 1.2% by mass, and particularly preferably 0.5 to 0.9% by mass, based on the total amount of refrigerating machine oil.

In a case where the refrigerating machine oil contains the glycidyl ether type epoxy compound as an epoxy compound, the content of the glycidyl ether type epoxy compound is preferably 0.01 to 2% by mass, more preferably 0.1 to 2% by mass, still more preferably 0.2 to 1.5% by mass, still further preferably 0.4 to 1.2% by mass, and particularly preferably 0.5 to 0.9% by mass, based on the total amount of refrigerating machine oil.

The mass ratio of the content of the acid scavenger to the content of hydrocarbyl hydrogen phosphite in the refrigerating machine oil (content of acid scavenger/content of hydrocarbyl hydrogen phosphite) is preferably 0.1 or more, more preferably 0.5 or more, still more preferably 1 or more, and preferably 30 or less, more preferably 10 or less, still more preferably 5 or less.

Examples of the antioxidant include phenol-based antioxidants such as di-tert.butyl-p-cresol. The content of the antioxidant may be, for example, 0.01% by mass or more and 5% by mass or less, based on the total amount of refrigerating machine oil.

Examples of the antiwear agent include phosphorus-based antiwear agents. Such a phosphorus-based antiwear agent may be a phosphoric acid ester such as triphenyl phosphate (TPP), tricresyl phosphate (TCP), and alkylated triphenyl phosphate to which an alkyl group having 1 to 4 carbon atoms has been added; or a thiophosphoric acid ester such as triphenylphosphorothionate (TPPT), dithiophosphoric acid ester, and dithiophosphorylated carboxylic acid and its derivative. The content of the above antiwear agent may be, for example, 0.01% by mass or more, or 0.1% by mass or more, and may be 5% by mass or less, or 3% by mass or less, based on the total amount of refrigerating machine oil.

In addition, the contents of the extreme pressure agent, the oiliness agent, the antifoaming agent, the metal deactivator, the viscosity index improver, the pour point depressant, and the detergent dispersant may be preferably 10% by mass or less, and more preferably 5% by mass or less, based on the total amount of refrigerating machine oil.

The kinematic viscosity of the refrigerating machine oil at 40° C. may be preferably 3 $mm^2/s$ or more, more preferably 4 $mm^2/s$ or more, and still more preferably 5 $mm^2/s$ or more. The kinematic viscosity of the refrigerating machine oil at 40° C. may be preferably 500 $mm^2/s$ or less, more preferably 400 $mm^2/s$ or less, and still more preferably 300 $mm^2/s$ or less. The kinematic viscosity of the refrigerating machine oil at 100° C. may be preferably 1 $mm^2/s$ or more, and more preferably 2 $mm^2/s$ or more. The kinematic viscosity of the refrigerating machine oil at 100° C. may be preferably 100 $mm^2/s$ or less, and more preferably 50 $mm^2/s$ or less.

The pour point of the refrigerating machine oil may be preferably −10° C. or lower, and more preferably −20° C. or lower. The pour point in the present invention means a pour point measured in accordance with JIS K2269:1987.

The volume resistivity of the refrigerating machine oil may be preferably $1.0\times10^9$ Ω·m or more, more preferably $1.0\times10^{10}$ Ω·m or more, and still more preferably $1.0\times10^{11}$ Ω·m or more. The volume resistivity in the present invention means a volume resistivity at 25° C. measured in accordance with JIS C2101:1999.

The moisture content of the refrigerating machine oil may be preferably 200 ppm or less, more preferably 100 ppm or less, and still more preferably 50 ppm or less, based on the total amount of refrigerating machine oil. The moisture content in the present invention means a moisture content measured in accordance with JIS K2275.

The acid value of the refrigerating machine oil may be preferably 0.6 mgKOH/g or less, more preferably 0.2 mgKOH/g or less, still more preferably 0.1 mgKOH/g or less, and particularly preferably 0.05 mgKOH/g or less. The acid value of the refrigerating machine oil may be less than 0.01 mgKOH/g in terms of being excellent in stability, but is preferably 0.01 mgKOH/g or more, more preferably 0.02 mgKOH/g or more, and still more preferably 0.03 mgKOH/g or more, in terms of the balance between antiwear property and stability. In this respect, although the acid value of hydrocarbyl hydrogen phosphite in the present embodiment is low, it is desirable to adjust the amount of the antioxidant having a certain numerical value added to the refrigerating machine oil according to the desired balance between antiwear property and stability. The acid value in the present invention means an acid value measured in accordance with JIS K2501:2003.

The ash content of the refrigerating machine oil may be preferably 100 ppm or less, and more preferably 50 ppm or less. The ash content in the present invention means an ash content measured in accordance with JIS K2272:1998.

The refrigerating machine oil according to the present embodiment is usually present as a working fluid composition for a refrigerating machine which is mixed with a refrigerant in a refrigerating machine. That is, the refrigerating machine oil according to the present embodiment is used together with the refrigerant, and the working fluid composition for the refrigerating machine according to the present embodiment contains the refrigerating machine oil and a refrigerant according to the present embodiment.

Examples of such a refrigerant include fluorine-containing ether-based refrigerants such as saturated fluorinated hydrocarbon refrigerants, unsaturated fluorinated hydrocarbon refrigerants, hydrocarbon refrigerants, and perfluoroethers, bis(trifluoromethyl)sulfide refrigerants, trifluoroiodomethane refrigerants, natural refrigerants such as ammonia and carbon dioxide, mixed refrigerants of two or more kinds selected from these refrigerants.

Examples of the saturated fluorinated hydrocarbon refrigerant include saturated fluorinated hydrocarbons having, preferably, 1 to 3 carbon atoms, more preferably 1 to 2 carbon atoms. Specific examples thereof include difluoromethane (R32), trifluoromethane (R23), pentafluoroethane (R125), 1,1,2,2-tetrafluoroethane (R134), 1,1,1,2-tetrafluoroethane (R134a), 1,1,1-trifluoroethane (R143a), 1,1-difluoroethane (R152a), fluoroethane (R161), 1,1,1,2,3,3,3-heptafluoropropane (R227ea), 1,1,1,2,3,3-hexafluoropropane (R236ea), 1,1,1,3,3,3-hexafluoropropane (R236fa), 1,1,1,3,3-pentafluoropropane (R245fa), and 1,1,1,3,3-pentafluorobutane (R365mfc), or mixtures of two or more thereof.

Although the saturated fluorinated hydrocarbon refrigerant is appropriately selected from the above depending on the application and required performance, preferred examples thereof include R32 alone; R23 alone; R134a alone; R125 alone; a mixture of R134a/R32=60 to 80% by mass/40 to 20% by mass; a mixture of R32/R125=40 to 70% by mass/60 to 30% by mass; a mixture of R125/R143a=40 to 60% by mass/60 to 40% by mass; a mixture of R134a/R32/R125=60% by mass/30% by mass/10% by mass; a mixture of R134a/R32/R125=40 to 70% by mass/15 to 35% by mass/5 to 40% by mass; a mixture of R125/R134a/R143a=35 to 55% by mass/1 to 15% by mass/40 to 60% by mass. More specifically, it is possible to use a mixture of R134a/R32=70/30% by mass; a mixture of R32/R125=60/40% by mass; a mixture of R32/R125=50/50% by mass (R410A); a mixture of R32/R125=45/55% by mass (R410B); a mixture of R125/R143a=50/50% by mass (R507C); a mixture of R32/R125/R134a=30/10/60% by mass; a mixture of R32/R125/R134a=23/25/52% by mass (R407C); a mixture of R32/R125/R134a=25/15/60% by mass (R407E); a mixture of R125/R134a/R143a=44/4/52% by mass (R404A) and the like.

The unsaturated fluorinated hydrocarbon (HFO) refrigerant is preferably fluoropropene, and more preferably fluoropropene which has 3 to 5 fluorine atoms. Specifically, it is preferable that the unsaturated fluorinated hydrocarbon refrigerant be any one or a mixture of two or more of 1,2,3,3,3-pentafluoropropene (HFO-1225ye) and 1,3,3,3-tetrafluoropropene (HFO-1234ze), 2,3,3,3-tetrafluoropropene (HFO-1234yf), 1,2,3,3-tetrafluoropropene (HFO- 1234ye), and 3,3,3-trifluoropropene (HFO-1243zf). From the viewpoint of the physical characteristics of the refrigerant, it is preferable that the amount is one or two or more selected from HFO-1225ye, HFO-1234ze and HFO-1234yf.

The hydrocarbon refrigerant is preferably a hydrocarbon having 1 to 5 carbon atoms, and more preferably a hydrocarbon having 2 to 4 carbon atoms. Specific examples of the hydrocarbon include methane, ethylene, ethane, propylene, propane (R290), cyclopropane, normal butane, isobutane, cyclobutane, methylcyclopropane, 2-methylbutane, normal pentane, or mixtures of two or more thereof. Among these, those which are gaseous at 25° C. and 1 atm are preferably used, and propane, normal butane, isobutane, 2-methylbutane or a mixture thereof is preferable.

The content of the refrigerating machine oil in the working fluid composition for a refrigerating machine may be preferably 1 to 500 parts by mass, more preferably 2 to 400 parts by mass with respect to 100 parts by mass of the refrigerant.

The refrigerating machine oil and the working fluid composition for a refrigerating machine according to the present embodiment are suitably used for an air conditioner having a reciprocating or rotary hermetic compressor, a refrigerator, an open or hermetic car air conditioner, a dehumidifier, a water heater, a freezer, a freezing and refrigerating warehouse, an automatic vending machine, a showcase, a refrigerating machine such as a chemical plant, a refrigerating machine having a centrifugal compressor, and the like.

EXAMPLES

Hereinafter, the present invention will be described in more detail based on Examples, but the present invention is not limited to Examples.

The refrigerating machine oil was prepared by blending the base oil shown below and various additives so as to have the compositions shown in Tables 1 and 2 (% by mass based on the total amount of refrigerating machine oil). In addition, the refrigerating machine oil was prepared by adding a base oil to a mixture of additives obtained by mixing the above various additives.

(Base Oil)

A1: mixed base oil of the following (a1) and (a2) (mixing ratio (mass ratio): (a1)/(a2)=70/30)

(a1) polyol ester of pentaerythritol and a mixed fatty acid of 2-methylpropanoic acid/3,5,5-trimethylhexanoic acid (mixing ratio (mass ratio): 60/40) (kinematic viscosity at 40° C.: 46 $mm^2/s$, kinematic viscosity at 100° C.: 6.3 $mm^2/s$)

(a2) complex ester (kinematic viscosity at 40° C.: 146 $mm^2/s$, viscosity index: 140) obtained by further reacting 3,5,5-trimethylhexanol (1.1 mol) with an ester intermediate obtained by reacting neopentyl glycol (1 mol) and 1,4-butanediol (0.2 mol) with adipic acid (1.5 mol), and removing remaining unreacted materials by distillation.

(Hydrocarbyl Hydrogen Phosphite)

B1: mono and di(2-ethylhexyl) hydrogen phosphite (acid value: 15 mgKOH/g)

B2: mono and dilauryl hydrogen phosphite (acid value: 63 mgKOH/g)

B3: mono and diphenyl hydrogen phosphite (acid value: 44 mgKOH/g)

B4: mono and dioleyl hydrogen phosphite (acid value: 5 mgKOH/g) B5: mono and diphenyl hydrogen phosphite (acid value: 274 mgKOH/g)

(Other Additives)

C1: Epoxy-based acid scavenger (glycidyl neodecanoate)

Other additives: Including antioxidants and phosphorus-based antiwear agents

For each of the refrigerating machine oils of Examples 1 to 12 and Comparative Examples 1 and 2, the antiwear property and stability in the refrigerant atmosphere were evaluated by the procedure shown below.

(Evaluation of Antiwear Property)

The antiwear property of the refrigerating machine oil on the day of preparation and after storage at room temperature for 2 weeks from the preparation date was evaluated by the procedure shown below.

A friction test device in which a vane (SKH-51) for the upper test piece and a disk (SNCM220 HRC50) for the lower test piece were used was mounted inside a closed container. Into a friction test site, 600 g of each refrigerating machine oil was introduced, the inside of the system was evacuated, and then 100 g of R32 refrigerant was introduced and heated. After setting the temperature in the closed container to 110° C., an antiwear property test was performed under a load of 1000 N and a rotation speed of 750 rpm, and wear amounts of the vane and the disc after the test for 60 minutes were measured. The evaluation results of antiwear property on the day of preparation are shown in Tables 1 to 3. The smaller wear amounts mean better antiwear property. Further, as shown in Table 4, it was indicated that there is a tendency in that the refrigerating machine oil of Comparative Example 2 deteriorates in antiwear property after being stored at room temperature for 2 weeks from the preparation date. Meanwhile, when the antiwear property of the refrigerating machine oils of Examples 10 to 12 was similarly evaluated after storage for 2 weeks, it was confirmed that the antiwear property did not significantly deteriorate even after 2 weeks. This result is better than the result of Example 1, and indicated that there is a tendency in that a hydrocarbyl hydrogen phosphite having a long-chain hydrocarbon group such as an alkyl or alkenyl group having 12 to 18 carbon atoms as a substituent maintains the antiwear property for a long period of time.

(Evaluation of Stability)

Stability during refrigerant mixing was evaluated in accordance with ES K2211:2009 (autoclave test). That is, 30 g of refrigerating machine oil in which the moisture content has been adjusted to 1000 ppm was weighed in an autoclave, and a catalyst (iron, copper, aluminum wire, each having an outer diameter of 1.6 mm×length of 50 mm) and 30 g of R32 were sealed, heated at a temperature of 175° C. for 168 hours. The acid value (post-test acid value) of each refrigerating machine oil after the test was measured in accordance with ES K2501:2003. The results are shown in Tables 1 to 3.

TABLE 1

| | | Example 1 | Example 2 | Example 3 | Example 4 | Example 5 |
|---|---|---|---|---|---|---|
| Composition (% by mass) | A1 | Balance | Balance | Balance | Balance | Balance |
| | B1 | 0.1 | 0.3 | 0.5 | — | — |
| | B2 | — | — | — | 0.2 | 0.3 |

TABLE 1-continued

| | | Example 1 | Example 2 | Example 3 | Example 4 | Example 5 |
|---|---|---|---|---|---|---|
| | C1 | 0.9 | 0.9 | 0.9 | 0.9 | 0.9 |
| | Other additives | 1.8 | 1.8 | 1.8 | 1.8 | 1.8 |
| Acid value of refrigerating machine oil (mgKOH/g) | | 0.02 | 0.03 | 0.05 | 0.13 | 0.19 |
| Antiwear property | Wear amount of vane (μm) | 0.7 | 0.8 | 0.8 | 1.0 | 1.0 |
| | Wear amount of disc (μm) | 0.25 | 0.32 | 0.27 | 0.55 | 0.55 |
| Stability | Acid value (mgKOH/g) | 0.96 | 0.95 | 1.54 | 0.96 | 1.23 |

TABLE 2

| | | Example 6 | Example 7 | Example 8 | Example 9 | Example 10 |
|---|---|---|---|---|---|---|
| Composition (% by mass) | A1 | Balance | Balance | Balance | Balance | Balance |
| | B3 | 0.1 | 0.3 | — | — | — |
| | B4 | — | — | 0.1 | 0.3 | 0.5 |
| | C1 | 0.9 | 0.9 | 0.9 | 0.9 | 0.9 |
| | Other additives | 1.8 | 1.8 | 1.8 | 1.8 | 1.8 |
| Acid value of refrigerating machine oil (mgKOH/g) | | 0.04 | 0.13 | <0.01 | 0.02 | 0.03 |
| Antiwear property | Wear amount of vane (μm) | 1.2 | 1.0 | 1.0 | 1.2 | 0.9 |
| | Wear amount of disc (μm) | 0.75 | 0.60 | 0.16 | 0.58 | 0.35 |
| Stability | Acid value (mgKOH/g) | 0.76 | 1.28 | 0.14 | 0.68 | 0.47 |

TABLE 3

| | | Example 11 | Example 12 | Comparative Example 1 | Comparative Example 2 |
|---|---|---|---|---|---|
| Composition (% by mass) | A1 | Balance | Balance | Balance | Balance |
| | B2 | 0.1 | 0.15 | — | — |
| | B5 | — | — | — | 0.3 |
| | C1 | 0.9 | 0.9 | 0.9 | 0.9 |
| | Other additives | 1.8 | 1.8 | 1.8 | 1.8 |
| Acid value of refrigerating machine oil (mgKOH/g) | | 0.06 | 0.19 | <0.01 | 0.8 |
| Antiwear property | Wear amount of vane (μm) | 0.8 | 0.9 | >3 | 1.0 |
| | Wear amount of disc (μm) | 0.3 | 0.63 | >2.5 | 0.6 |
| Stability | Acid value (mgKOH/g) | 0.57 | 0.42 | — | >2 |

TABLE 4

| | | Example 10 | Example 11 | Example 12 | Comparative Example 2 |
|---|---|---|---|---|---|
| Antiwear property (after storage for 2 weeks) | Wear amount of vane (μm) | 0.9 | 0.9 | 0.9 | >3 |
| | Wear amount of disc (μm) | 0.25 | 0.23 | 0.25 | >2.5 |

The invention claimed is:

1. A method for producing a refrigerating machine oil, comprising: blending a combined hydrocarbyl hydrogen phosphite having an acid value of 100 mgKOH/g or less with a lubricating base oil or an oil composition comprising a lubricating base oil; wherein the combined hydrocarbyl hydrogen phosphite comprises a monohydrocarbyl hydrogen phosphite and a dihydrocarbyl hydrogen phosphite.

2. The method according to claim 1, wherein the acid value of the combined hydrocarbyl hydrogen phosphite is 30 mgKOH/g or less.

3. The method according to claim 1, wherein the acid value of the combined hydrocarbyl hydrogen phosphite is 10 mgKOH/g or less.

4. A refrigerating machine oil obtained by blending a combined hydrocarbyl hydrogen phosphite having an acid value of 100 mgKOH/g or less with a lubricating base oil or an oil composition comprising a lubricating base oil;

wherein the hydrocarbyl hydrogen phosphite comprises a monohydrocarbyl hydrogen phosphite and a dihydrocarbyl hydrogen phosphite.

5. The refrigerating machine oil according to claim 4, wherein the acid value of the combined hydrocarbyl hydrogen phosphite is 30 mgKOH/g or less.

6. The refrigerating machine oil according to claim 5, wherein the acid value of the combined hydrocarbyl hydrogen phosphite is 10 mgKOH/g or less.

* * * * *